US009915059B2

(12) United States Patent
Grover et al.

(10) Patent No.: US 9,915,059 B2
(45) Date of Patent: Mar. 13, 2018

(54) OVERFLOW VENT SCOOP FOR FLUSH VALVE

(71) Applicant: AS IP Holdco, LLC, Piscataway, NJ (US)

(72) Inventors: David Grover, Hamilton, NJ (US); Christophe Bucher, Hillsborough, NJ (US); Sara Salahi, North Brunswick, NJ (US)

(73) Assignee: AS IP HOLDCO, LLC, Piscataway, NJ (US)

( * ) Notice: Subject to any disclaimer, the term of this patent is extended or adjusted under 35 U.S.C. 154(b) by 534 days.

(21) Appl. No.: 14/183,290

(22) Filed: Feb. 18, 2014

(65) Prior Publication Data

US 2014/0230136 A1 Aug. 21, 2014

Related U.S. Application Data

(60) Provisional application No. 61/765,552, filed on Feb. 15, 2013.

(51) Int. Cl.
*E03D 9/04* (2006.01)
*E03D 1/34* (2006.01)

(52) U.S. Cl.
CPC *E03D 1/34* (2013.01); *E03D 9/04* (2013.01)

(58) Field of Classification Search
CPC ..... E03D 9/04
(Continued)

(56) References Cited

U.S. PATENT DOCUMENTS 1,895,786 A * 1/1933 Cobb ..... E03D 1/34 4/399
2,632,895 A * 3/1953 Teahen ..... E03D 1/34 4/399

(Continued)

FOREIGN PATENT DOCUMENTS

CN 201047108 Y 4/2008
GB 2277940 A 11/1994

(Continued)

OTHER PUBLICATIONS

PCT International Search Report and Written Opinion from counterpart PCT/US2014/016961 (Jun. 2014) (16 pages).

(Continued)

*Primary Examiner* — Lori Baker
(74) *Attorney, Agent, or Firm* — Venable, LLP; Michele V. Frank, Esq.

(57) ABSTRACT

A vent cover is described herein which may be used with various flush valve assemblies, particularly those acceptable for high efficiency and high performance toilets, which vent cover has a wall that includes an upper portion, a lower portion configured to define a vent cover inlet opening for receiving air and/or liquid passing upwardly from within a valve body and/or from within a toilet through a toilet inlet when the vent cover is installed on a valve body, an exterior surface, and an interior surface defining a vent cover passage for air passing upwardly from the vent cover inlet opening. At least the upper portion of the vent cover wall is configured for contacting an interior surface of a valve body at a location above an inlet of an overflow or venting tube on a valve body when the vent cover is installed on a valve body and wherein the valve cover wall is configured to at least partially divert flow of fluid from entering an inlet of an (Continued)

overflow tube or a venting tube on a valve body when the vent cover is installed on a valve body.

32 Claims, 11 Drawing Sheets

(58) Field of Classification Search
USPC ..... 4/300–442
See application file for complete search history.

(56) References Cited

U.S. PATENT DOCUMENTS

| | | | | |
|---|---|---|---|---|
| 2,640,995 | A | 6/1953 | Wilt | |
| 2,779,027 | A | 1/1957 | Jensen | |
| 2,904,794 | A * | 9/1959 | Goldtrap | E03D 1/34 4/399 |
| 3,102,275 | A * | 9/1963 | Raymond | E03D 9/052 4/213 |
| 3,108,287 | A * | 10/1963 | Stallworth | E03D 1/304 343/911 R |
| 4,385,912 | A * | 5/1983 | Parrick | B01D 50/002 4/209 R |
| 4,841,579 | A * | 6/1989 | Antunez | E03D 1/35 4/393 |
| 5,123,124 | A * | 6/1992 | Brower | A47K 13/10 4/217 |
| 5,353,444 | A | 10/1994 | Osmond | |
| 5,415,374 | A * | 5/1995 | Carroll | F16K 31/3835 251/40 |
| 5,487,194 | A | 1/1996 | Kightlinger | |
| 5,792,305 | A * | 8/1998 | Winsemius | H01L 21/67126 156/345.11 |
| 5,926,861 | A * | 7/1999 | Frost | E03D 1/142 4/324 |
| 6,086,041 | A * | 7/2000 | Gattuso | B60N 2/0232 137/884 |
| 6,295,656 | B1 * | 10/2001 | Tillen | E03D 9/05 4/216 |
| 6,704,945 | B2 | 3/2004 | Bellmore | |
| 6,715,162 | B2 * | 4/2004 | Han | E03D 1/34 4/378 |
| 6,728,975 | B2 * | 5/2004 | Han | E03D 1/34 4/324 |
| 6,901,610 | B1 * | 6/2005 | Jensen | E03D 1/34 4/324 |
| 6,910,232 | B2 * | 6/2005 | Antunez | E03D 5/092 4/353 |
| 6,971,400 | B1 | 12/2005 | Bowman et al. | |
| 7,192,002 | B2 | 3/2007 | Nortier | |
| 7,562,399 | B2 | 7/2009 | Parsons et al. | |
| 7,676,858 | B2 | 3/2010 | Halloran et al. | |
| 7,856,675 | B1 | 12/2010 | Couturier et al. | |
| 8,079,095 | B2 * | 12/2011 | Jensen | E03D 1/304 4/397 |
| 8,266,733 | B2 | 9/2012 | Jensen | |
| 8,266,735 | B2 | 9/2012 | McLeod | |
| 2005/0087710 | A1 * | 4/2005 | Nortier | F16K 31/3835 251/40 |
| 2005/0109965 | A1 * | 5/2005 | Nortier | F16K 31/3835 251/30.01 |
| 2007/0101486 | A1 | 5/2007 | Torres et al. | |
| 2010/0299823 | A1 | 12/2010 | Stack et al. | |
| 2012/0210506 | A1 | 8/2012 | Miwa et al. | |
| 2015/0013058 | A1 * | 1/2015 | Bucher | E03D 9/035 4/378 |

FOREIGN PATENT DOCUMENTS

| | | | |
|---|---|---|---|
| GB | 2281750 | A | 3/1995 |
| KR | 10-0952879 | B1 | 4/2010 |

OTHER PUBLICATIONS

International Preliminary Report on Patentability from counterpart PCT/US2014/016961 (Aug. 2015) (10 pages).
First Chinese Office Action dated Jul. 19, 2016 in Chinese Application No. 2014800088082 (counterpart application of U.S. Appl. No. 14/183,290) (11 pages).
Response to First Chinese Office Action of Dec. 5, 2016 in Chinese Application No. 201400088082 (counterpart application of U.S. Appl. No. 14/183,290) (66 pages).
Second Office Action dated Feb. 15, 2017 in corresponding Chinese Patent Application No. 2014800088082 with English translation (12 pages).
Notice of Third Office Action received in corresponding Chinese Patent Application No. 201480008808.2, dated Oct. 10, 2017, and English translation thereof (6 pages).

* cited by examiner

OVERFLOW VENT SCOOP FOR FLUSH VALVE

CROSS-REFERENCE TO RELATED APPLICATIONS

This patent application claims the benefit under 35 U.S.C. § 119(e) to U.S. Provisional Patent Application No. 61/765,552, filed Feb. 15, 2013, entitled, "Overflow Vent Scoop for Flush Valve," the entire disclosure of which is incorporated by reference herein.

BACKGROUND OF THE INVENTION

Field of the Invention

The invention relates to flush valves for toilets, urinals and the like, and more particularly to a modification to the design of such valves to provide a scoop or cover to be placed over the opening to an overflow tube or to a vent tube within the flush valve to help to divert water that may block an overflow tube and facilitate escape of air that may be otherwise trapped within the valve body, the valve throat and/or the toilet manifold.

Description of Related Art

Toilets and toilet assemblies for removing solid and liquid human waste are well known. Typically, toilets incorporate three systems that work together to perform the flushing action: (1) internal water channels of the toilet bowl, (2) the flush mechanism, and (3) the refill mechanism. Working in concert, these three systems enable the flushing function of the toilet.

Usually, a toilet tank, positioned over the back of the toilet bowl in a two-piece toilet assembly or in the upper part of a one-piece assembly with a tank portion, holds water that is used to both initiate flushing of waste from the toilet bowl, through a trapway and into a sewage drain line, and refill the bowl with fresh water. When a user wants to flush the toilet, the user pushes down on a flush lever or other flush actuator on the outside of the tank, which is connected on the inside of the tank typically to a movable chain and/or lever or mechanical flush valve actuator. When the flush lever is depressed on the outside of the tank, the chain or lever on the inside of the tank acts to lift and open a flush valve, enabling water to flow from the tank into the bowl to initiate a toilet flush cycle. In some toilet designs the toilet bowl does not have a tank on the rear portion of the tank, but instead may have an in-line flush valve mounted in a casing on the rear portion of the toilet and in communication with an incoming source of water.

In many toilet designs, water flows from a flush valve directly into the bowl inlet, and is then dispersed into a rim channel, a jet channel(s), an opening and/or directly into the toilet bowl through a manifold area located beneath the toilet bowl inlet. The water releases from the valve into the bowl through the toilet bowl inlet rather quickly, with flow from the flush valve entering the bowl typically lasting only approximately on half to four seconds. The water flows into the bowl either directly, from the rim channel and/or down a jet channel(s) within the bowl which introduces water into the bottom of the toilet bowl through a siphon jet outlet. The siphon jet releases most of the water into the trapway, which initiates siphon action. The siphoning action draws all the water and waste out the bowl, and into the trapway. The waste and water continues through the other end of a generally U-shaped trapway and is released into the wastewater or sewage drain line connected at the base of the toilet.

Once the tank is emptied during the flush, the flush valve closes, and a floating mechanism(s) or other similar tripping device, depending on the flush valve and tank design, initiates opening of a filler valve in a toilet design having fillable tank. A filler valve provides fresh water to both the tank and the bowl through separate flows. Eventually, the tank fills with water to a level high enough to cause the float to rise, thus shutting off the fill valve. At this point, the flushing cycle is complete.

Government agencies have continually demanded that water use for flushing be reduced. Much of the focus in recent years has been to reduce the water demand required by toilet flushing operations. In order to illustrate this point, the amount of water used in a toilet for each flush has gradually been reduced by governmental agencies from 7 gallons/flush (prior to the 1950's), to 5.5 gallons/flush (by the end of the 1960's), to 3.5 gallons/flush (in the 1980's). The National Energy Policy Act of 1995 mandates that toilets sold in the United States can use water in an amount of 1.6 gallons/flush (6 liters/flush) or less.

One attempt in the art to produce a more reliable, more efficient and more powerful 1.6 gallon (6 liter) gravity flush toilet, known as a "high-performance toilet" (HPT), while overcoming the drawbacks in existing toilet technology by increasing the hydraulic energy available during the flushing operation, can be found in U.S. Pat. No. 6,901,610 entitled, "High Performance Valve Assembly For Toilets"; U.S. Pat. No. 6,728,975 entitled, "High Performance Flush Valve Assembly"; and U.S. Pat. No. 6,715,162 for "Toilet Assembly," commonly owned with the present application. Relevant portions of these patents to the extent they describe radiused inlet technology, general toilet tank operation and construction, and flush valve construction are incorporated herein by reference.

Hush valve assemblies for water tanks of toilets are described in U.S. Pat. Nos. 6,901,601, 6,723,975 and 6,715,162. These patents describe a flush valve having a valve body with a base sleeve portion including a radiused inlet to increase the discharge coefficient of the valve opening. A flush cover member is coaxially and slidably mounted with respect to the valve body so that the valve opening is created therebetween when the flush cover member is removed from the valve body via reciprocating motion. The flush cover member is slidably movable between a first position, wherein the flush cover member is seated on the base sleeve portion of the valve body and thereby obstructs water flow through the valve opening, and a second position, wherein the second valve member is removed from the base sleeve portion of the valve body to permit water flow through the valve opening. A sealing member is provided to ensure a proper seal when the flush cover member is in the first position, and a guiding means is provided that properly aligns and guides the flush valve cover relative to the valve body. The flush valve assembly also includes a trip release mechanism that releases the effects of the flush lever on the flush cover member when the flush cover member reaches its second position, thereby returning the flush cover member to its first rest position prior to the flush lever returning to its own corresponding rest position. In this configuration, the disclosed flush valve assembly ensures compliance with the mandated water requirements and simultaneously provides enhanced cleanliness and waste removal capabilities. The flush valve assembly achieves these functions and also releases the effect of the flush lever so that the valve opening can close before the expiration of a regulatory minimum "hold down" time (1 second without exceeding the total water per flush mandate of 1.6 gallons (6 liters)).

Alternative technologies proposed for providing adequate flush valve efficiency for high-performance toilets may be found in U.S. Pat. No. 7,676,858, which proposes use of a flush valve that has a valve body with a valve seat that defines a flow passage having a portion of its interior flow profile that narrows in a non-linear manner away from the valve seat such that the inner surface of the valve seat in the non-linear portion can be defined by a polynomial expression, i.e., the valve body has a non-linearly curved inner surface.

U.S. Pat. No. 8,079,095, owned by the present applicant, discloses a flush valve that accomplishes water conservation and flush efficiency, as well as the performance goals noted above, by providing a more efficient combination of a radiused inlet and an optional elevated valve body. The flush valve assembly disclosed therein may also have a "poppet" or centrally aligned and guided buoyant float cover for the valve body. This particular design is highly effective if an upwardly buoyant and centrally guided flush cover is used, because the upward lifting of such a cover provides for water intake into the valve opening in 360° configuration. That is, when the buoyant cover lifts, it allows for water to flow in from all directions into the valve opening for supplying water from the toilet tank to the toilet bowl.

As some problems are still encountered when using elevated valve bodies having an optimal radiused inlet designed to enhance flow and maximize hydraulic energy through the valve body with a standard flapper-type valve cover, other improvements have also been made in the art. Flush valve body assemblies having a radiused inlet and elevated valve body, used with the above-noted, poppet, centrally-guided flush cover, are able to handle the increased efficiency and maximized flow through the valve body at reduced volumes of water so as to be useful as high-performance flush valves working with HPT toilets having toilet bowl designs and flush pathways that achieve the 1.6 gallons/flush water conservation standards, some of which may be qualified as high-efficiency toilets (HET) which provide effective flushing at as low as about 1.28 gallon per flush or even lower.

Using a standard two-inch inlet, the flush volume through a high-efficiency flush valve designed to function with high-efficiency toilets (HETs) is very high, even though the volume in the toilet tank available for flushing is lower than prior art traditional toilets. A traditional flapper valve cover's performance used with such a valve body and a two-inch inlet can be affected in terms of its ability to close when appropriate, sometimes closing prematurely, and in terms of its ability to re-open. This problem can sometimes be exacerbated in a radiused inlet valve body design, because the extension of the inlet opening due to the presence of the radius, which is optimized for high-efficiency flow through the valve body. This can require an even larger sized flapper to cover the opening created by the radius thereby contributing to buoyancy issues affecting opening and closing of the flapper cover. These factors can combine to make it difficult to properly open and close a standard flapper on a valve assembly configured for use in an HPT or, preferably an HET and having an elevated valve body and radiused inlet, even in comparison to standard low profile, non-elevated flush valve bodies having standard flapper-type valve covers.

Other issues encountered in flush valve designs arise when such flush valves, whether suitable for high-efficiency toilets or not, are optimized for flow design, but have outlets which, when installed introduce fluid flow directly into an inlet chamber of a toilet bowl having a lower floor which lies in up/one perpendicular to the flow coming out of the flush valve outlet. The impact of the contact between the high flow rate through the valve caused by flushing against the floor of the inlet chamber of the toilet bowl introduces undesirable turbulence which reduces the hydraulic energy available from the water exiting the outlet of the flush valve. Prior art designs are available from the owner of the present application in which a fitting is used on the bottom of a flush valve outlet to divide and direct the flush valve outlet flow into two separate directions so as to introduce flow into the a rim area and into the jet area of the toilet bowl. Such designs do avoid some of the impact issue, for certain particular high-efficiency toilet designs.

Improvements in such designs are described in U.S. Pat. No. 8,266,733, of the applicant hereto, which discloses a valve having an elevated valve body that includes a wall extending between the upper inlet end and the lower outlet end of the valve body with an interior surface that defines flow path extending generally longitudinally through the valve body with a generally circular transverse cross-section. At least a portion of the wall is downwardly linearly tapered so that there is a decreasing valve body diameter and the tapered wall portion is positioned below the radiused inlet portion. The patent also describes a valve flapper with a bulb configuration more readily adaptable to address the buoyancy issues that arise from the high rate of flow through the valve body.

In a farther improvement, co-pending U.S. Provisional application Ser. No. 14/038,748, incorporated herein by reference, describes improved flush valves including those that may have an elevated valve body, wherein the valves incorporate a flush line that connects a flush actuating device to a flush valve cover. The flush line is for raising and lowering the flush valve cover upon actuation of the assembly. A float is connected to the flush valve cover via a the float line or is positioned along the flush line. The float is sufficiently buoyant so as to be capable of resisting the force of flowing water and keeps the flush valve cover open so as to allow flush water to pass through the valve body before closing the flush valve cover when the valve body is installed on a toilet.

Such improvements flow through flush valves, especially for HPT, and preferably HET toilet assemblies create additional challenges to improve efficiencies in flow to continue to improve valve and toilet flush performance while enabling continued conservation of water use. Flow through many of the above-noted high flow valves, which include elevated valve bodies, linearly or non-linearly tapered designs, poppet designs and/or use radiused inlets, can still have issues in terms of turbulence or high flow of water blocking the entrance to the overflow tube of the valve and/or preventing air from escaping the valve, such as through the overflow or vent tubes in the valve designs. As flow rates through the valve are more laminar and fast, as the valve opens to allow water to rush through the valve body towards the toilet, air from within the system can cause obstruction to the benefit achieved by the incoming flow. If the air can pass easily out of the system, any such impact can be minimized. However, the force of the flow can back up the water into the overflow and/or vent tubes from within the valve body in various designs, a typical exit path for air, thus blocking an easy outlet passage for the trapped air. The less trapped air in the incoming flow the better. As a result, there is a need in the art for a way to reduce any negative impact to air release without negatively compromising the enhanced flow rates and flow dynamics achievable by the above-noted improved high efficiency flush valves.

BRIEF SUMMARY OF THE INVENTION

The invention includes a vent cover designed for use with a flush valve assembly, comprising a vent cover wall including an upper portion, a lower portion configured to define a vent cover inlet opening for receiving air passing upwardly from within a valve body and/or from within a toilet through a toilet inlet when the vent cover is installed on a valve body, an exterior surface, and an interior surface defining a vent cover passage for air passing upwardly from the vent cover inlet opening, wherein at least the upper portion of the vent cover wall is configured for contacting an interior surface of a valve body at a location above an inlet of an overflow tube or a vent tube on a valve body when the vent cover is installed on a valve body and wherein the valve cover wall is configured to at least partially divert flow of fluid from entering an inlet of an overflow tube or a venting tube on a valve body when the vent cover is installed on a valve body.

The vent cover wall may also be configured to allow air and/or fluid entering the vent cover from the vent cover inlet opening to pass upwardly through the vent cover passage and to exit the vent cover into an inlet of an overflow tube or a venting tube of a valve body when the vent cover is installed on a valve body.

The vent cover may be formed so as to comprise a polymeric material. The vent cover wall is preferably curved, and has a body portion below the upper portion of the vent cover wall and above the lower portion of the vent cover wall and the inlet opening. The vent cover wall also preferably has a generally semi-circular configuration in transverse cross-section and a radius measured in a transverse direction across the vent cover such that the passage through the vent cover within the body portion of the vent cover wall also has a generally semi-circular configuration. The vent cover wall is also preferably formed so as to have an outer edge along at least the upper portion and the body portion of the vent cover wall. The radius of the vent cover wall may be constant in the body portion of the vent cover wall or the vent cover wall and/or its outer edge can taper so as to conform to an interior surface of a valve body wall, in which case the radius would decrease along the body portion from the upper portion to the lower portion. The upper portion of vent cover wall may also be preferably arcuately curved such that the radius of the vent cover wall decreases along the upper portion moving from the body portion of the vent cover wall towards the edge of the upper portion of the vent cover wall. The outer edge of the vent cover wall is preferably configured to meet an interior surface of a valve body of a flush valve in facing engagement when the vent cover is installed in a flush valve.

The vent cover may be formed of a material capable of being affixed to an interior surface of a valve body of a flush valve by an adhesive, ultrasonic welding and/or polymeric heat welding. The vent cover may also be formed of a material capable of being heat molded to an interior surface of a valve body of a flush valve.

In one embodiment, the vent cover also comprises projections that extend outwardly from the exterior surface of the vent cover wall and which are configured to engage a feature of a valve body and/or an interior surface of a valve body of a flush valve upon installation of the vent cover.

The invention also includes a flush valve assembly that comprises a valve body that has an upper inlet end having an inlet opening therethrough for receiving fluid into the flush valve body, a lower outlet end having an outlet opening therethrough for allowing fluid to exit the flush valve body, and a valve body wall extending between the upper inlet end and the lower outlet end and having an interior surface defining a flow path that extends generally longitudinally through the valve body from the inlet opening to the outlet opening, a valve body cover capable of opening and closing over the inlet opening of the valve body, an overflow or venting tube, having an inlet opening in communication with the flow path of the valve body and an outlet opening for releasing air and/or fluid from within the valve body, a vent cover having a vent cover wall, wherein the vent cover wall has with an upper portion, a lower portion defining an inlet opening for receiving air passing upwardly from within the valve body flow path and/or from a toilet through a toilet inlet, an exterior surface, and an interior surface defining a vent cover passage for receiving air and/or liquid from the inlet opening of the vent cover, wherein at least the upper portion of the vent cover wall contacts the interior surface of the valve body at a location above the inlet opening of the overflow or venting tube and the passage is configured to at least partially divert flow of fluid from entering an inlet of the overflow or venting tube on the valve body when the vent cover is installed on a valve body.

The vent cover wall may also be configured to allow air and/or fluid entering the vent cover from the vent cover inlet opening to pass upwardly through the vent cover passage and to exit the vent cover into an inlet of the overflow or venting tube of the valve body.

The valve body design may vary, and can be formed as a HET or HPT valve body. In one embodiment, it may have a valve body upper inlet end formed so as to comprise a radiused inlet. The valve body in this or another embodiment may have an elevated valve body, in that the largest diameter of the valve body is smaller than the height of the valve body. In a further embodiment, the valve cover may be a buoyant poppet float coaxially mounted in the valve body for reciprocating motion with respect to said valve body along a guide member.

The valve body may also have at least a portion of the interior surface of the valve body wall downwardly linearly tapered so as to have a decreasing valve body diameter as measured transversely across the valve body. The valve body wall may also comprise an upper inlet section, abuse section for attaching to a toilet tank floor, and an extension section situated between the inlet section and the base section, wherein at least one of an interior surface of the base section and of the extension section is tapered so as to have a linearly decreasing diameter from an upper end of each section in a direction toward a lower end of each section, wherein the diameters are measured transversely across each section.

The valve body of the assembly in another embodiment may be an elevated valve body, wherein the upper inlet end of the valve body further comprises a radiused inlet and the tapered portion of the valve body wall is below the radiused inlet portion. In another embodiment, the valve body wall may comprise an upper inlet section, a base section for attaching to a toilet tank floor, and an extension section situated between the inlet section and the base section wherein at least one of an interior surface of the base section and of the extension section is tapered so as to have a linearly decreasing diameter from an upper end of each section in a direction toward a lower end of each section, wherein the diameters are measured transversely across each section.

In the flush valve assembly, the vent cover may have a wall that is curved and have a vent cover wall body portion below the upper portion of the vent cover wall and above the lower portion of the vent cover wall and the vent cover inlet opening, wherein the vent cover wall has a generally semi-circular configuration in transverse cross-section and has a radius measured in a transverse direction across the vent cover such that the vent cover passage within the body portion of the vent cover wall also has a generally semi-circular cross-sectional configuration. The radius of the vent cover wall may be constant in the body portion of the vent cover wall if the vent cover wall is generally linear and perpendicular, or the vent cover wall can be tapered to conform to a tapered interior surface of a valve body, in which case the radius may decrease from the upper portion to the lower portion of the vent cover wall along the body portion of the vent cover wall. Further, the upper portion of vent cover wall may be arcuately configured to curve towards the interior surface of the valve body so that the radius of the vent cover wall, measured transversely across the vent cover, decreases along the upper portion of the vent cover wall as the vent cover wall approaches the interior surface of the valve body.

In the assembly, the vent cover wall may also have an outer edge along the body portion and the upper portion of the vent cover wall, wherein the outer edge is configured for meeting the interior surface of the valve body in facing engagement. The vent cover may be affixed to the interior surface of the valve body by an adhesive, ultrasonic welding and/or polymeric heat welding or can be heat molded to the interior surface of the valve body. In the assembly, the vent cover may be molded as a unitary part of the valve body.

The vent cover in the assembly may also farther comprise projections extending outwardly from the exterior surface of the vent cover wall which are configured for engaging a feature of the valve body and/or the interior surface of the valve body.

The vent cover can also have varying lengths as measured longitudinally through the valve cover. In embodiments herein, the vent cover can be made to have a length as measured longitudinally from the bottom of an overflow or venting tube inlet to the bottom of the vent cover body, i.e., at the vent cover inlet, of about 0 to about 100 mm below the bottom of an inlet of an overflow or venting tube, preferably about 10 mm to about 70 mm below the bottom of an inlet of an overflow or venting tube, and more preferably about 25 to about 65 mm below the bottom of the inlet of an overflow or venting tube.

In one embodiment of the assembly, an upper inlet end of the valve body may comprise a radiused inlet, the valve body may be an elevated valve body, and the valve cover configured as a buoyant poppet float coaxially mounted in the valve body for reciprocating motion with respect to said valve body along an guide member, wherein the vent cover further comprises projections extending outwardly from the exterior surface of the wall which are configured for engaging the guide member of the valve body.

In a further embodiment herein, the invention includes a flush valve assembly for a toilet tank, the flush valve assembly, comprising, a flush valve having a valve body comprising an upper inlet end having an inlet opening therethrough for receiving fluid into the flush valve body, wherein the upper inlet is a radiused inlet, a lower outlet end having an outlet opening therethrough for allowing fluid to exit the flush valve body, and a valve body wall extending between the upper inlet end and the lower outlet end and having an interior surface defining a flow path that extends generally longitudinally through the valve body from the inlet opening to the outlet opening, wherein the valve body has an elevated base section; and a movable poppet cover capable of moving in a coaxial, reciprocating manner; and a vent cover having a vent cover wall, wherein the vent cover wall has with an upper portion, a lower portion defining an inlet opening for receiving air passing upwardly from within the valve body flow path and/or from a toilet through a toilet inlet, an interior surface defining a vent cover passage for receiving air from the inlet opening of the vent cover, wherein at least the upper portion of the vent cover wall contacts the interior surface of the valve body wall at a location configured to at least partially divert flow of fluid in a valve body when the vent cover is installed and/or to facilitate escape of trapped air.

In one embodiment of such a flush valve assembly, the flush valve poppet cover may comprise a guide rod and the valve body may comprise a web structure having a central hole configured to receive the guide rod, and the guide rod is capable of reciprocatably and coaxially moving within the hole so as to raise the poppet cover to allow fluid to flow into the inlet of the flush valve in an open position and to allow for aligned axial movement of the poppet cover when the flush valve moves to a closed position.

BRIEF DESCRIPTION OF THE SEVERAL VIEWS OF THE DRAWING(S)

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
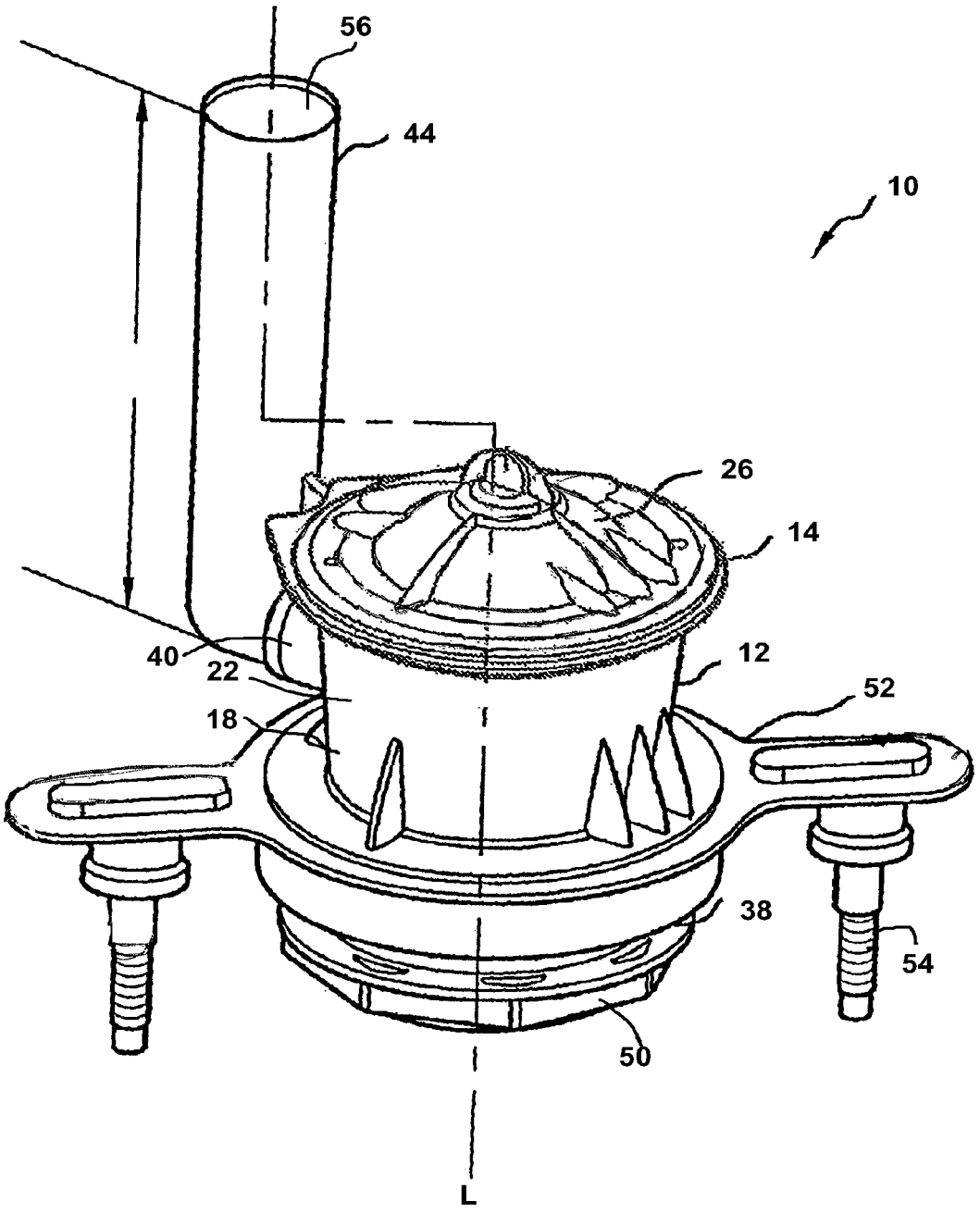
FIG. 1 is a perspective view of a valve assembly having a poppet float and valve body with a vent cover according to an embodiment herein.

A vent cover is described herein for use with various flush valve assemblies, particularly those useful for high efficiency and high performance toilets. HET and HPT compliant assemblies and valve bodies with high flush capacity can have issues with a large and generally streamlined flow of flush water entering the valve body and being drawn in by the valve body design, such as those with radiused inlets and the like. As a result, the entrance to the overflow tube and/or the vent tube of the valve assembly, which typically is useful for releasing upwardly mobile air trapped in the system, either in the valve body prior to entrance of flush water through the valve body from the toilet tank, or in the toilet itself, can be blocked by the incoming flush water.

The present vent cover addresses that issue and provides a simple and inexpensive solution to enhance performance of a toilet system including a toilet flush valve. The vent cover will be described in connection with one such HET valve design, a poppet valve assembly, however, it should be understood that the vent cover can be used with a variety of flush valve designs for improving performance.

As used herein, words such as "upper" and "lower," "interior" and "exterior," "inner" and "outer," "top" and "bottom," and words of similar import are intended to be used to better understand the invention when explained with reference to directions in the drawings incorporated in this disclosure. They are for illustrative purposes only, are intended to have their ordinary meaning and import, and are not otherwise intended to be limiting with respect to the scope of the invention.

Figure 2:
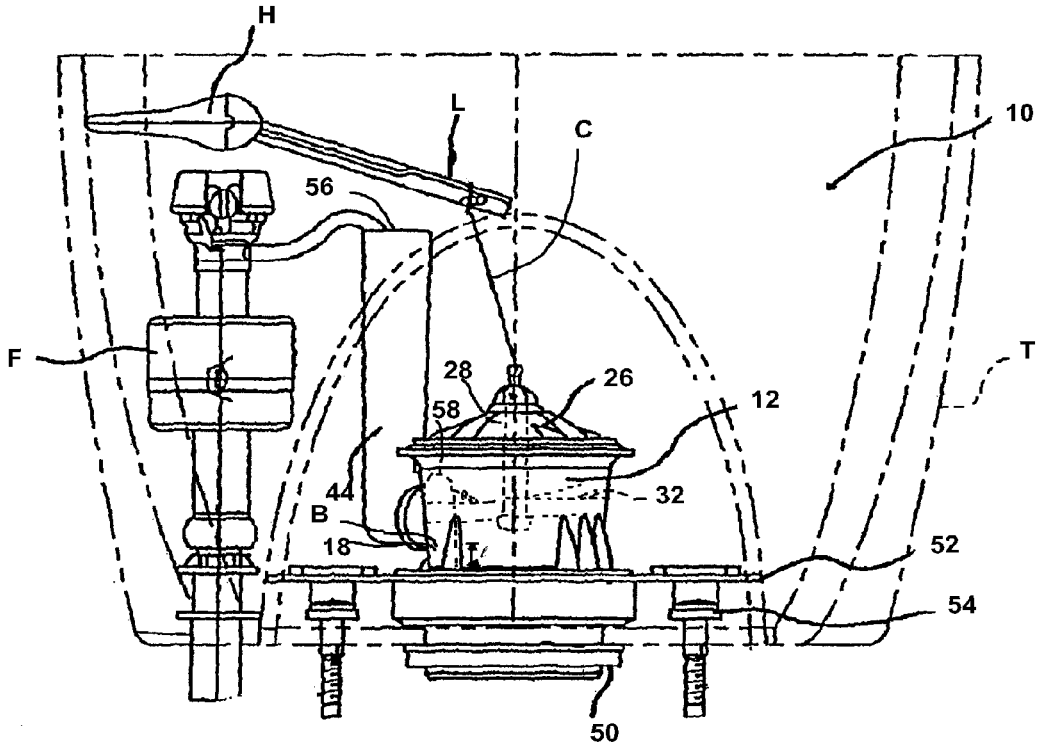
FIG. 2 is a side elevational view of the inside of a toilet tank having the valve assembly of FIG. 1 therein.

As shown in FIGS. 1-5, an example of a flush valve assembly which may include a vent cover is shown. The flush valve assembly, generally referred to herein as assembly 10 includes a valve body 12. The valve body as shown corresponds to that of U.S. Pat. No. 8,079,095, incorporated herein by reference with respect to the valve assembly. The valve body 12 has an upper inlet end 14 having an inlet opening 16 therethrough. The upper inlet end is designed to receive fluid that enters into the flush valve body from a water source, and typically from within a toilet tank T as shown in FIG. 2. The valve body further includes a lower outlet end 18 which defines an outlet opening 20 therethrough. Hush fluid, including water, exits the flush valve body 12 through the outlet and typically would pass into the inlet of a toilet upon which tank T is installed. From there, fluid passes into a various interior geometries of a toilet bowl, which can be varied to include rim channels and/or jet channels and in most cases an initial manifold where incoming water is directed to various channels and/or openings in the bowl. After the flush cycle is over, that water is drawn from the toilet bowl by siphon through a trapway to a sewage outlet, and the flush valve is closed. A filling valve F is then triggered to re-fill the tank for the next flush cycle.

The valve body 12 has a valve body wall 22 that extends between the upper inlet end 14 and the lower outlet end 18. The wall has art interior surface 24 that defines a flow path FP that extends generally longitudinally through the valve body 12 from the valve body inlet opening 16 to its outlet opening 20. The outlet opening 20 is preferably of a similar cross-sectional configuration to the lower section of the valve body and as shown, in this embodiment is generally circular in cross-section. In a preferred embodiment of such a valve body, the inner diameter of the outlet is about 3.0 in, to about 3.5 in such that flush valve assembly 10 for use in standard commercial toilet embodiments, however, the diameter of the valve body at the inlet and outlet may vary depending on the desired design.

The valve body 12 in the valve assembly 10 is preferably opened and closed by way of a cover 26. The cover 26 is capable of opening and closing over the inlet opening 14 of the valve body 12. The cover 26 may be varied in design depending on the valve body, and sized to work with the valve body, including having a slightly larger size than a standard flapper cover if needed to adequately work from a buoyancy perspective and to close properly on a radiused inlet common in HET and HPT valve assemblies. The valve may also have additional features if desired, such as floats, extra cover features and the like.

As noted above, the flush valve assembly 10 is preferably located and installed in a tank T of a toilet and communicates with a conventional fill valve (see FIG. 2). Any suitable tank design and fill valve may be used as are known in the art or to be developed. When a flush actuator, such as a handle or similar mechanism is pushed, a flush is initiated and the flush valve assembly will also be actuated. As shown in FIG. 2, a flush handle H is in mechanical cooperation, such as by pivoting, with a lever L having a chain C. The chain (which could also be a simple line) is connected to the cover 26. Other flush mechanisms (electronic or manual) may be used as well.

Valve body 12 includes a movable poppet cover 26 or seal that moves in a reciprocating manner via a guide rod 28 of a length designed to work within a particular size valve body 12. As shown, the upper end 14 of the valve body 26 has a radiused inlet 30. The mechanism for reciprocating movement may include any feature 32 or features that allow for coaxial, reciprocating movement of a rod 28 or similar element within the valve body for facilitating opening, which in the embodiment shown involves lifting the cover by depressing the handle H to move the lever L, pull up on the chain C and raise the cover 26. Detailed description of one such design may be found in U.S. Pat. No. 8,079,095. In FIGS. 1-5, a molded web structure 34 having a central hole 36 for receiving the rod 28 is shown. However, it should be understood that the feature 32 can be varied to accomplish this purpose within the scope of the invention described herein.

As shown, in addition to providing the valve body upper inlet end 14 with an optional, but preferred, radiused inlet 30, the valve body may also include an elevated base section 38. In one embodiment, the radiused inlet 30 has a preferred outer diameter (OD) of about 5 in. An extension 40 may be provided to the valve body 12 that has an opening 42 defined for receiving and/or fitting over or into an overflow tube 44. An overflow tube 44 may be any suitable overflow tube in the art. The overflow tube 44 has an inlet 46 which lies flush with the interior surface 24 of the valve body 12 and/or extends inwardly into the valve body 12 to some degree. While a standard overflow tube is shown herein, it will be understood to those skilled in the art, that the valve body in the assemblies herein may benefit from the vent cover described herein on either a standard overflow tube or any other venting tube provided on the valve body. For purposes of convenience, in this detailed description and embodiment, as well as in the below described alternative embodiment having a different valve body design, reference is made to an overflow tube, but such reference is not meant to be limiting and is intended to be also useful on other typical venting tubes provided on valve bodies that may become blocked for air release due to the nature of the flow (quantity, speed, etc.) through the valve body.

The elevated base section 38 may be provided to elevate the valve body 12 relative to the floor of the toilet tank T. Exterior threads 48 may be provided along at least part of the elevated base section 38 to help secure the valve assembly 10 to a tank T and also to a toilet bowl on installation via a plurality of threads and corresponding fastening member 50 (e.g., a nut) as is known in the art. A gasket or seal may also be used to ensure a water-tight fit. It will be understood based on the disclosure that other mechanisms for securing the valve body may be used, and this particular embodiment is only intended to be an example embodiment and not to limit how the valve body is connected to the tank and/or bowl. An optional bracket 52 or other fastening mechanism may also be used to further secure the valve body using a screw 54 or the like if desired.

The poppet cover 26 is coaxially and slidably mounted with respect to the valve body through feature 32. When the valve is open and the cover is lifted, the inlet opening 16 to the valve body 12 is in fluid communication with water from the tank T. It moves from a first rest position (see FIG. 2) upwardly. When open, in a second position the flush is initiated and the valve stays open until the cycle is complete.

When open, and upon elevation of the cover 26, buoyant forces and fluid pressure exerted on a bottom surface of the cover (which may include an optional seal thereon) prompts elevation of poppet cover 26 above inlet opening 16 of the valve body 12. When the buoyant force exceeds the hydrodynamic fluid force (e.g., the water level in tank T is high and the fluid "suction" on the poppet cover 26 is low prior to tank discharge), the poppet cover 26 lifts above a radiused inlet 30. Flush water can then flow into the inlet opening 16 and proceed into the valve body. The guide rod 28 remains in alignment with the hole 36 in the web 34 to ensure an axial return path to the valve's closed position. Buoyant forces and fluid pressure in equilibrium keep the poppet cover elevated for a time sufficient to empty the contents of the tank and initiate refilling thereof by filler valve F. As the tank volume discharges through valve inlet opening 16, the water level in tank T decreases and poppet cover 26 descends toward the radiused inlet 30. Increasing hydrodynamic forces acting upon the cover 26 counteract the buoyant force to allow a generally rapid descent of the poppet cover 26 and decrease the available area to allow water to enter the valve until the initial valve rest position is regained.

It is noted that the elevated base section 38, if provided to the valve body, raises the effective head level of the flush valve assembly 10. The elevated head reduces the available volume for tank discharge yet realizes improved discharge performance through a discharge outlet. The preferred embodiment shown of a poppet valve assembly combines a radiused inlet configuration with an elevated valve body such that the effective head is approximately equal to that used in conventional flush valves, when the radius of the radiused inlet is preferably about 0.75 in. to about 1 in. This has the advantage also of reducing the available maximum discharge water volume, while realizing superior water discharge that uses the entire outlet diameter. The valve body wall 12 further preferably includes a slight tapering along a profile thereof such that the inner diameter thereof gradually decreases.

The overflow tube 44, has an inlet typically positioned within the valve body flow path FP or positioned so as to be flush with the interior surface 24 of the valve body 12. The inlet opening 46 is open to the interior of valve body and is in communication with the flow path FP within the valve body 12 so that backflow liquid due to blockage and trapped air can exit into the overflow tube. The overflow tube 44 also preferably has an outlet opening 56 for releasing air and/or fluid from within the overflow tube coming from the interior of the valve body 12. The configuration and size of the inlet to an overflow tube or venting tube in a flush valve may vary and it should be understood within the scope of the invention that the vent cover described herein can be varied also in configuration to accommodate such in et variations.

The invention provides a vent cover 58 having a vent cover wall 60. The vent cover wall 60 and vent cover are preferably formed as a unitary piece, however, it is possible within the scope of the invention that certain portions are separately formed and molded or otherwise joined together. The wall 60 of the vent cover 58 has with an upper portion 62, a body portion 64 and a lower portion 66. The lower portion 66 defines an inlet opening 68 to the vent cover 58 for receiving air passing upwardly (arrow A) from within the valve body flow path and/or from a toilet through a toilet inlet (not shown). The vent cover wall 60 further has an exterior surface 70 and an interior surface 72. The interior surface is configured to define a vent cover passage 74 for receiving air from the inlet opening of the vent cover 58. At least the upper portion 62 of the vent cover wall preferably contacts the interior surface 24 of the valve body 12 at a location Q or area above the inlet opening 46 of the overflow tube 44. The passage 74 is configured to allow air and/or water entering the vent cover 58 from the vent cover inlet opening 68 to pass upwardly through the vent cover passage 74 and then to exit the vent cover 58 through the inlet opening 46 of the overflow tube 44. While the vent cover 58 can be attached in only one area and/or pressure fit against the interior surface 24 of the valve body, it is preferred that it be attached by way of the outer edge 76 of the vent cover wall 60 extending around the vent cover, at least around the upper portion 62 and the body portion 64 of the vent cover wall. The outer edge may be flush or have an extending portion as shown for ease of attachment and stability against the interior surface 24 of the valve body. If an extending edge is used, it is not necessary to include it around the bottom portion 66 with the exception of where it will abut the valve body wall.

The outer edge 76 and the shape of the vent cover can vary and may be shaped so as to conform to the interior surface 24 of the valve body 12 if desired. The vent cover wall and/or the outer edge thereof is preferably configured to preferably contact the interior surface of a valve body at a location above an inlet of an overflow or other venting tube on a valve body when the vent cover is installed on a valve body, and preferably optionally may also be configured so that the entire outer edge 76 contacts the interior surface 24 of the valve body with the exception of the bottom portion that is intended to be separated from the interior surface of the valve body so as to provide the passage 74.

The vent cover may be formed of a variety of materials, such as, for example, metals and metal alloys (e.g., copper, brass, nickel, lead, titanium, stainless steel, etc.) as well as polymeric or hard rubber materials (e.g., polystyrene-butadiene-styrenes (SBS), polyacrylonitrile-butadiene-styrenes (ABS)), polyamides (PA), polyimides (PI), polyarylenes (polyetherether ketone (PEEK), polyether ketone (PEK), polyether ketone ketone (PEKK) and the like), polyethylene sulfones (PES), polyetherimides (PEI), polytetrafluoroethylene (PTFE), fluoroplastics (FEP and PFA), olefinic rubbers, polyethylenes (PE), polypropylenes (PP), polyvinylchloride (PVC), polyoxyalkylenes (i.e., polyacetals) (e.g., polyoxymethylenes (POM), polyoxyethylenes (POE), polyoxybutylenes (POB), etc.), styrene-maleic-anhydrides (SMA), and other similar molding materials, composites, blends and/or copolymers of these materials, provided the materials provide adequate strength and resist deformation over time in contact with water under pressure. Composite materials may include fibrous and particulate materials such as glass fibers, carbon fibers, aramid fibers, Kevlar®, mica, carbon powder, and other fillers known in the art. Similar materials to those noted above may also be used to form various parts of the valve body and cover.

The vent cover wall 60 is preferably curved to accommodate upward flowing air and/or liquid in an amount adequate to alleviate negative impact of trapped air while otherwise minimizing any interference with the downward flow through the valve body during a flush cycle. Thus a curved design assists in avoiding turbulence and interruption to a more laminar flow pattern contributed to by the radiused inlet and/or tapered and/or elevated valve body design. It will be understood, however, based on this disclosure that a variety of cross-sectional configurations and wall designs could be used for varied effects or manufacturing reasons, including, for example, a conical configuration having a semi-circular cross-section but larger at the lower portion of the vent cover and narrowing to a small end at the upper portion, a bent plate configuration which has more of a rectangular or trapazoidal cross-section and that may or may not have varying widths along its length, and the like.

As shown in the Figures, along the body portion 64, and below the upper portion 62 of the vent cover wall and above the lower portion 66 of the vent cover wall 60 and above the inlet opening 68, the vent cover wall has a generally semi-circular configuration in transverse cross-section and has a radius R associated therewith that is measured in the transverse direction across the vent cover 58. As shown in FIG. 1, a longitudinal axis L runs through the valve body 12. The radius R is measured in a direction perpendicular to such axis and any parallel longitudinal axis through the vent cover when installed. The passage 74 through the vent cover 58 within the body portion 64 of the vent cover wall also has a generally semi-circular configuration. The radius R of the vent cover wall 58 is relatively constant in the body portion 64 of the vent cover wall with the exception that there may be provided some gradual tapering to meet the configuration of the valve body interior surface 24 if desired, when the vent cover 58 is installed, to prevent an escape of air by directing the air by using a tighter seal between the outer edge 76 of the vent cover wall 60 and the interior surface 24 of the valve body 12. Thus the radius R may be constant for a perpendicularly extending valve body wall, or, if desired, the outer edge 76 and body portion 64 slightly tapered to meet the configuration of the interior surface 24 of the valve body 12. As shown, the outer edge is slightly tapered such that the radius R would decrease from the upper portion 62 of the vent cover wall 60 towards the lower portion 66 of the vent cover 58.

It should be understood that in the embodiment shown, the general concept incorporates the facing outer edge of the vent cover wall and/or the overall vent cover wall structure conformed to work with and accommodate the shape of the interior surface of the valve body. Similarly, while the vent cover is shown in a semi-circular cross-sectional configuration, it should be understood that other shapes are contemplated and are within the scope of the invention, including a fully circular tube, a generally elliptical shape or semi-elliptical shape, a generally rectangular configuration, a generally triangular configuration, polygonal configuration, or the like. In selecting the optimal shape, the interior surface of the valve body to which the vent cover is to be attached or installed as well as the flow characteristics within that valve may be taken into account.

In the embodiment shown, the outer edge 76 of the vent cover wall 60 preferably extends along the upper portion 62 and the body portion 64 of the vent cover wall 60, and the upper portion 62 of vent cover wall is also preferably arcuately curved such that the radius R the vent cover wall in the upper portion will decrease along the upper portion of the vent cover wall from the body portion of the vent cover wall towards the edge of the upper portion of the vent cover wall as it approaches connection to the interior surface of the valve body at a location above the inlet of the overflow tube. The outer edge 76 of the vent cover wall 60 also as shown is configured so as to meet the interior surface 24 of a valve body 12 of a flush valve assembly 10 in facing engagement when the vent cover 58 is installed in a flush valve assembly 10 although it need not be.

The vent cover preferably has a length as measured parallel to a longitudinal axis of the vent cover. It need not be longer than necessary to cover an opening inlet to an overflow or venting tube in the valve body, hut should preferably at least cover the inlet of the overflow or vent tube. Preferably, it extends for an additional length l below the bottom 77 of the inlet of the overflow tube 44 or other vent tube. The length l may be varied for optimal effects using varying vent cover configurations and in various types of valve bodies. As shown, the vent cover has a length l as measured longitudinally from the bottom 77 of an inlet 46 of an overflow tube 44 or venting tube inlet to lower portion 66 of the vent cover body, i.e., at the vent cover inlet 68, of about to about 100 mm below the bottom of an inlet of an overflow tube or venting tube, preferably about 10 mm to about 70 mm below the bottom of an inlet of an overflow or venting tube, and more preferably about 25 to about 65 mm below the bottom of the inlet of an overflow or venting tube.

The vent cover and the vent cover wall are preferably formed of materials such as those noted above. Where affixed to the interior surface of the valve body of the flush valve assembly, the vent cover may be attached by adhesive, ultrasonic welding and/or polymeric heat welding. In addition, the vent cover may be formed of a material that is capable of being heat molded to an interior surface of the valve body of a flush valve. The vent cover may also be integrally molded into a flush valve body.

As shown, the vent cover may also be mounted within the valve body not only by molding or adhesive but through mechanical methods, including providing a connector or other aspect to the wall that assists in connecting it to the interior surface of the valve body.

Figure 3:
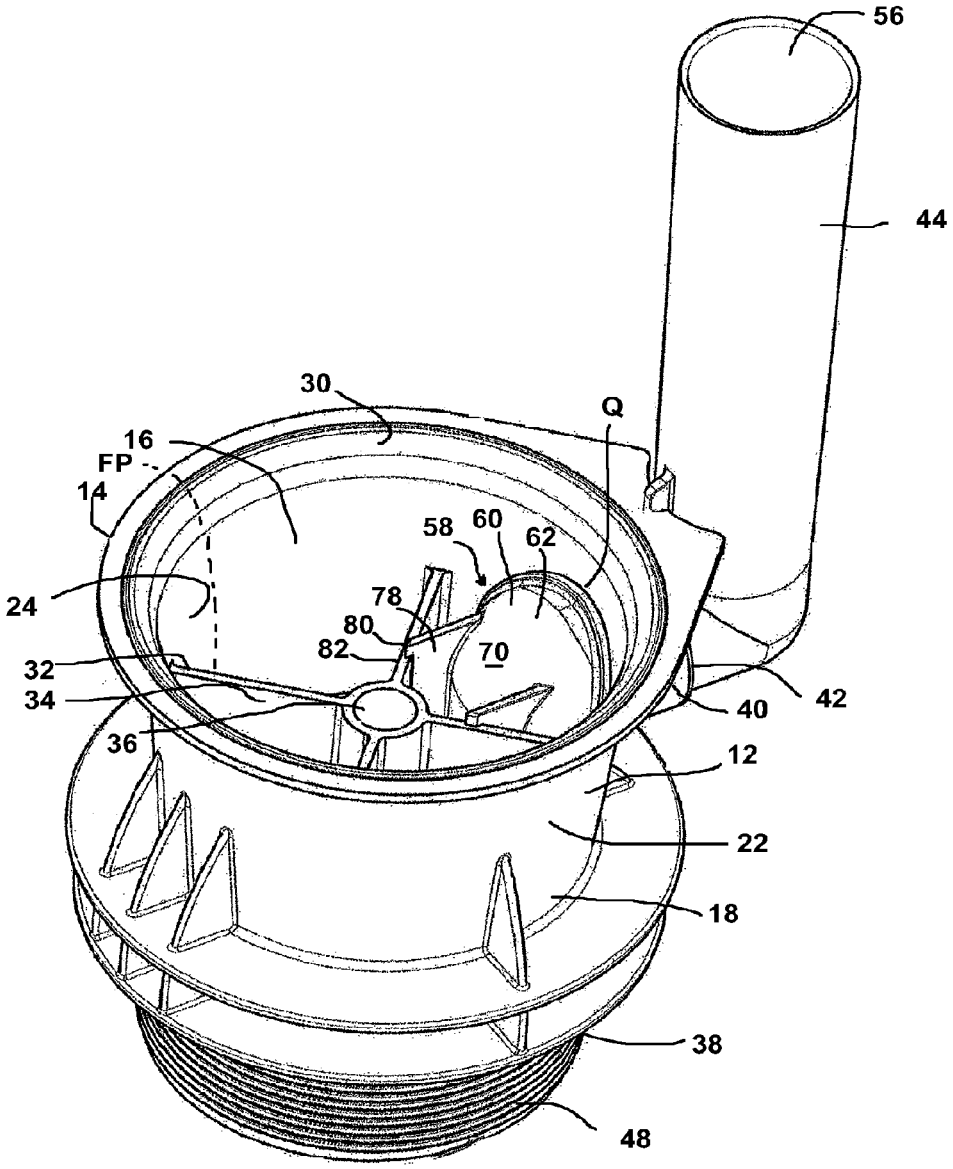
FIG. 3 is a perspective view of the valve assembly in FIG. 1 without the float cover showing a vent cover inside installed in the valve body.
Figure 4:
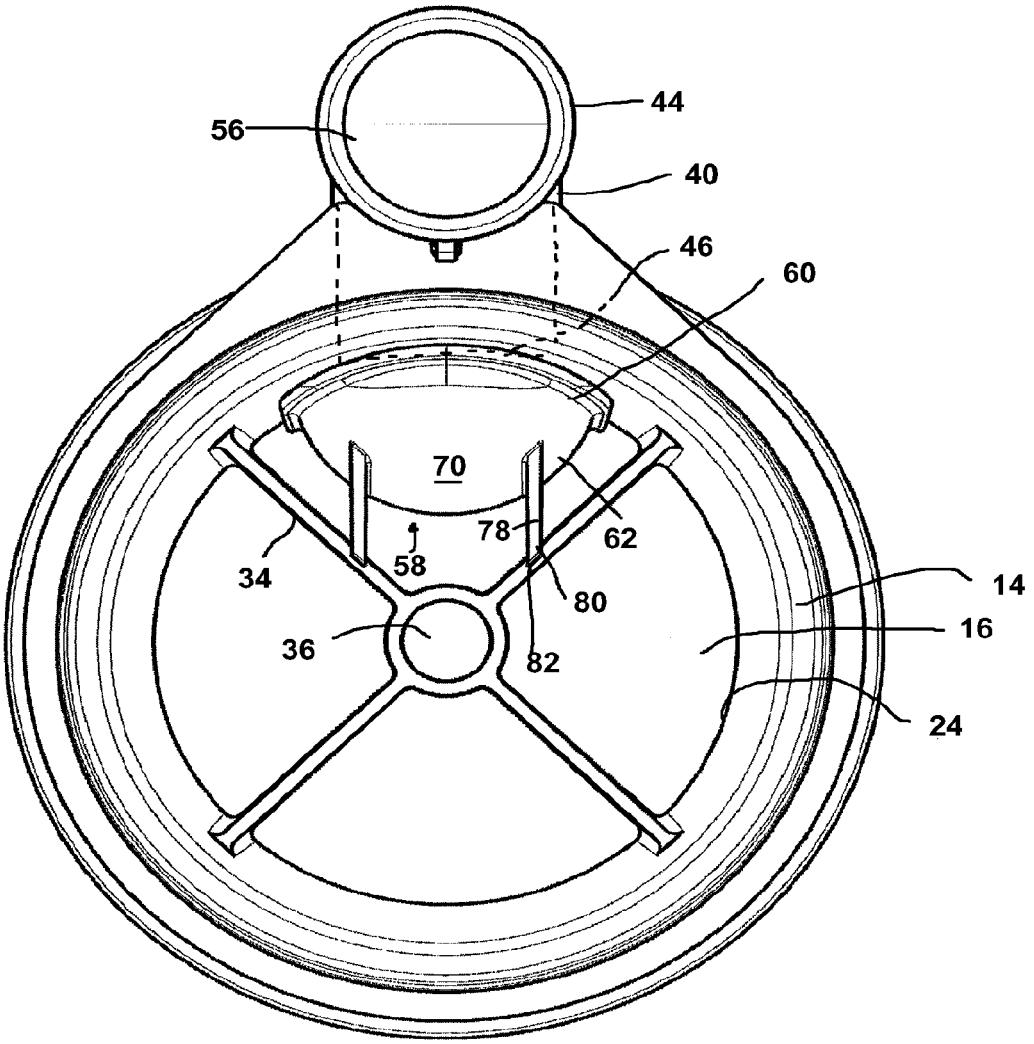
FIG. 4 is a top plan view of the valve body of FIG. 3.
Figure 5:
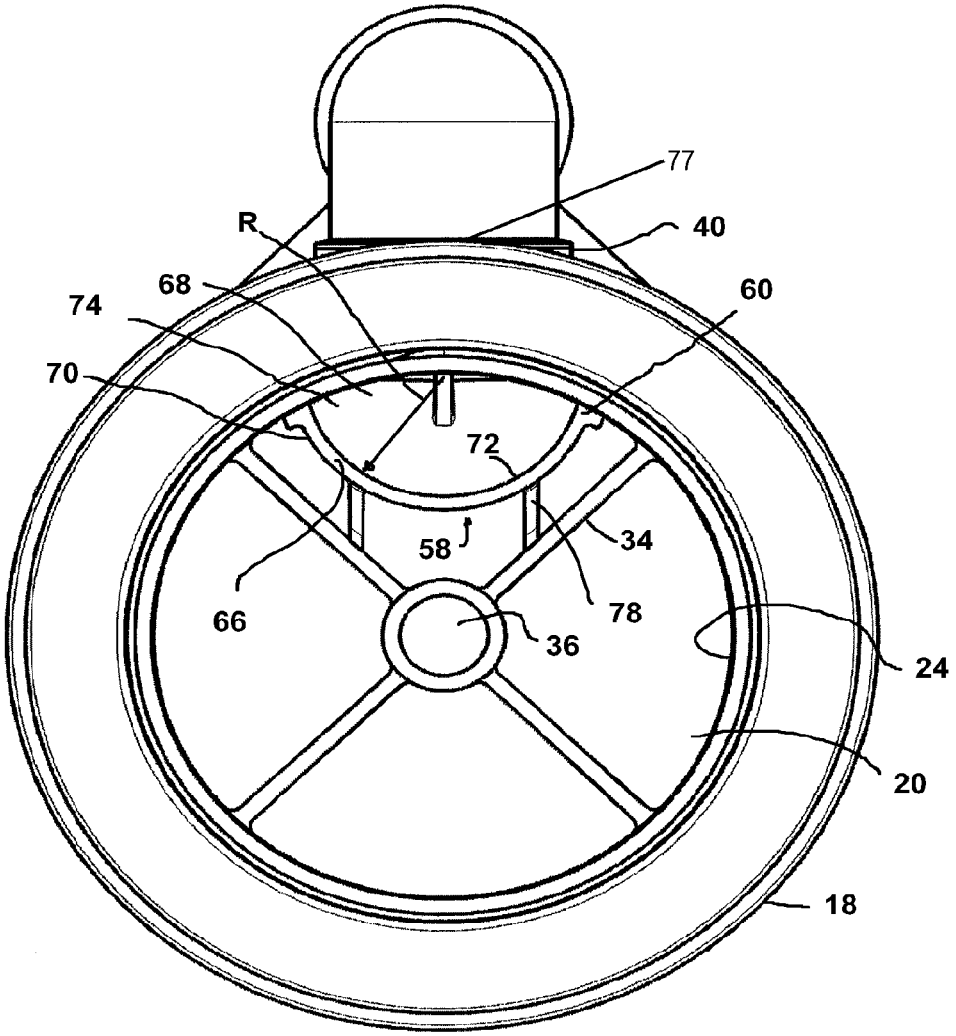
FIG. 5 is a bottom plan view of the valve body of FIG. 3.

As shown best in FIG. 3, projections 78 may be provided that extend outwardly from the exterior surface 70 of the vent cover wall 60 and which are configured for engaging a feature 82 of a valve body 12 by way of a hook or end piece 80 on the end of the projections 78. Alternatively or in addition, the projections could be made so as to engage the interior surface of the valve body of a flush valve upon installation of the vent cover such as by providing a hole or catch on the interior surface.

Figure 10:
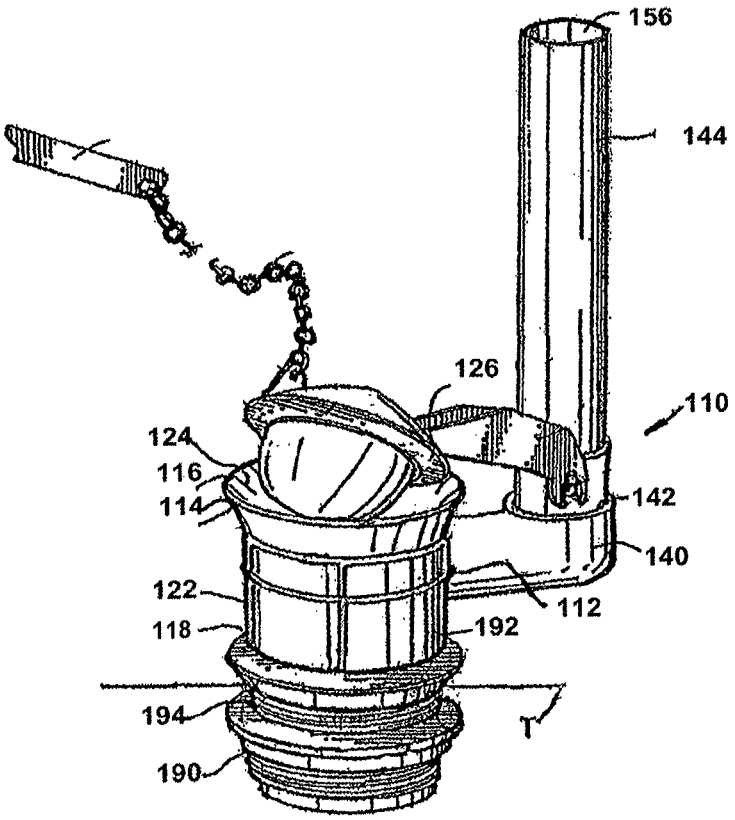
FIG. 10 is a perspective view of an alternative embodiment of a valve assembly having a vent cover therein.
Figure 11:
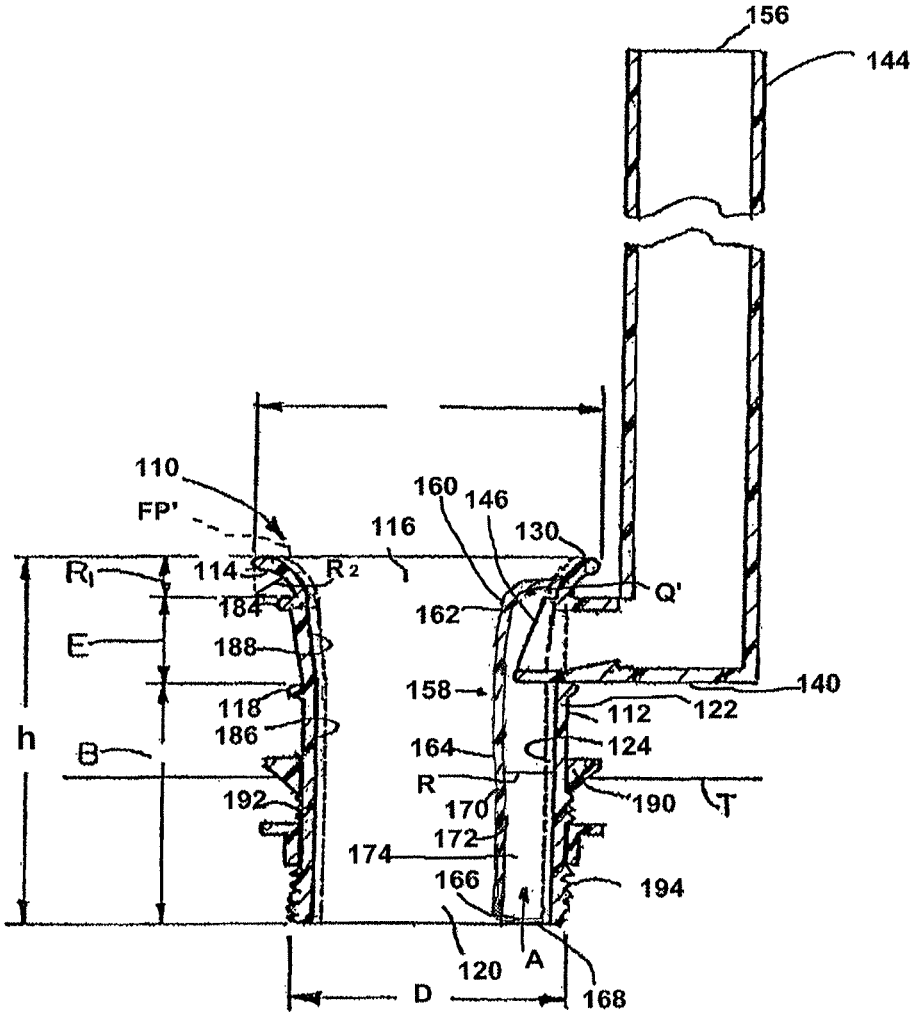
FIG. 11 is a side view of the valve body and overflow tube of the assembly of FIG. 10 showing the vent cover installed within the valve body of the assembly.

Another embodiment of a flush valve assembly 110 herein is shown to illustrate installation of a vent cover 158 within a different design flush valve. As shown in FIGS. 10 and 11, the flush valve assembly 110 has a valve body 112 with a valve body wall 122 that includes an upper inlet section 114, a base section 118 similar to a lower section in the prior embodiment for attaching to a toilet tank T via the tank floor. The valve body 112 may further include an extension section 184 situated between the inlet section 114 and the base section 118. Such a flush valve assembly may be seen in U.S. Pat. No. 8,266,733, incorporated herein by reference with respect to the valve design. In a preferred embodiment, at least one of an interior surface 186 of the base section 118 and an interior surface 188 of the extension section 184 is tapered. The valve body has a diameter D measured transversely across the valve body. The diameter D in a tapered design as shown would decrease linearly from an upper end of each section in a direction toward a lower end of each section as shown in FIG. 11, wherein the diameters are measured transversely across each section. However, it is also within the scope of the invention to use non-linear tapering as taught in U.S. Pat. No. 7,676,858, also incorporated herein by reference in relevant part with respect to the valve design.

The valve body 112 as shown is farther an elevated valve body and an HET or HPT design. The upper inlet end 114 of the valve body further comprises a radiused inlet 130 and it is preferred that any tapered portion of the valve body wall 122 be below the radiused inlet portion 130.

The valve body wall 122 as shown comprises an upper inlet section having a height shown as $R_1$, abuse section having a height shown as B for attaching to a toilet tank floor, and an extension section having a height E situated between the inlet section and the base section.

The radiused inlet portion 114 has a curved arcuate profile and radiused inlet 130 which in a longitudinal cross section, for example as shown in FIG. 11, preferably forms a circular segment having a radius $R_2$ which can be measured under the curved surface of the radiused inlet 130. The radiused inlet allows water flowing into the valve body in curves over the radiused inlet 130 into the valve body 112. It also provides a larger inlet area on the upper inlet end 114 of the valve body 112. The radius of the radiused inlet 130 may be varied from about ⅛ inch to about 1 inch, but is preferably about ⅛ inch to about ⅜ inch, and most preferably about ⅜ inch when the diameter of the lower outlet end 22 is about 2 inches.

The valve body has a wall 122 that extends between the upper inlet end 114 to the lower outlet end 118 but at the very bottom of the valve body 112. The ends are preferably situated so that upon installation the upper inlet end 114 is located in a tank T of a toilet and the lowermost portion of the base section B or lower end 118 is located below the tank T floor as shown. In cross-sectional configuration, the inlet of the valve body has a generally circular shape, which means a curved configuration such as a circle, oval, elliptical or egg-shaped configuration, but is preferably circular. The wall 122 may be an integrally formed wall such as to form a unitary structure valve body or may be formed of segments as discussed herein, it should also be understood that the certain segments of the wall may be integrally formed together while others can be made to be detachably connected. The segments of the wall body may thus be molded together, formed as separate piece(s) and fused or detachably connected to one another, such as by chamfering (described elsewhere herein with respect to the radiused inlet), snap-lock edge fittings, detents, screws, bolts, interlocking snap-fit pieces, connectors, and the like. Any suitable connection mechanism for adjoining the pieces may be used, provided the pieces form a tight fit and are leak-resistant. To assist in being leak-resistant, if separate pieces are joined together through mechanical mechanisms, such as screws, fittings, connectors and the like, it is preferred that a sealing member is placed between adjoining pieces. Sealing members may be, for example, standard elastomeric or plastic O-ring(s) or gasket(s) suitable for plumbing use. Such sealing members are optional if the pieces form a leak-tight fit and are not needed if the pieces are fused or molded together.

The wall has an interior surface 124 extending the length of the valve body wall that defines the flow path FP'. The flow path FP' takes the shape of the interior surface of the body wall and extends through the entire inner space of the valve body so as to create a flow path profile when viewed in longitudinal cross section through the valve body. The flow path FP' also has a generally circular transverse cross section along the valve body, however, as explained above, the diameter D of the cross section can vary over the length of the flow path. As used herein, "diameter" means the longest measure across the generally circular cross section in a transverse direction.

The valve body 112 is preferably an elevated valve body. The height h measured longitudinally along the valve body 112 is greater than the largest diameter D of the transverse cross-section of the flow path (in this case measured at the radiused inlet 130). This configuration allows for installation of the valve body in the toilet tank so as to provide for an elevated valve body portion lying above the toilet tank floor T. This configuration raises the flow rate through the valve body over standard valve bodies and creates more dynamic flow through the valve body while achieving the same head (distance from the upper surface of the tank water to the "choke" point or point of construction of the valve body).

The precise height h of the valve body may be varied, but it is preferred that the height h is sufficient so that the length of the valve body above the tank floor T is larger than a standard low profile valve body and preferably approximates or is greater than the largest diameter D. The height h is preferably greater than about 2.8 inch and can be as much as about 5.2 inches, and more preferably is about 3.5 inches to about 4.1 inches. The diameter D is greater than about 2.0 inches, and preferably is about 2.25 inches to about 3.5 inches, more preferably about 2.4 inches to about 3.3 inches and most preferably about 3.2 inches to about 3.25 inches. The ratio of the height h to the diameter d is preferably about 2.3 about 0.8 and more preferably about 1.7 to about 1.1.

The valve assembly 110 further includes a valve cover 126 as shown in FIG. 10, which is preferably a flapper valve cover, but may be an modified flapper cover as described in U.S. Pat. No. 8,266,733, incorporated herein in relevant part, and is preferably sufficiently large so as to cover the inlet opening 130 for closing the valve body and preferably is slightly larger so as to contact and close across the radiused inlet.

A sealing ring 190 may also be provided as is known in the art to seat the valve body 112 against the opening in the tank T in the floor thereof. The outer surface 192 of the valve body 112 along the base portion 118 is preferably threaded so as to have threads 194 for receiving a locking connection ring or similar device for securing the seal against the tank. While a ring, threaded end and locking connector are shown in FIGS. 10 and 11, it should be understood based on the disclosure that other locking and sealing mechanisms may be used within the scope of the invention.

Thus, the vent cover 10, 110 herein can be slightly modified in shape or configuration to conform to various HET and HPT valve body designs, including those highlighted herein, but also others in existence or to be provided. It has a minimal impact on the flow path while providing the benefit of substantially diverting the flow of water that may block the overflow tube and/or allowing a release path for trapped air in the system that otherwise may be blocked from exiting through the overflow tube inlet or a venting tube inlet due to the high flow of water through the valve body under such advanced valve body designs incorporating features like a 360° inlet path as in a poppet valve, radiused inlets and/or elevated valve bodies.

The invention will now be described with reference to the following non-limiting Example:

EXAMPLE

Figure 6:
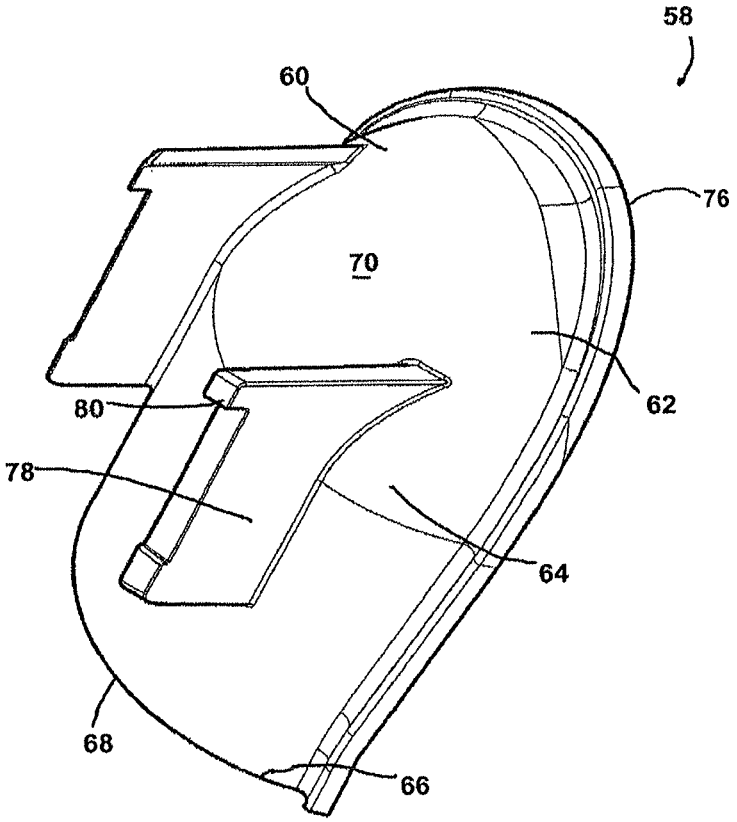
FIG. 6 is a perspective view of a vent cover according to an embodiment of the invention.
Figure 7:
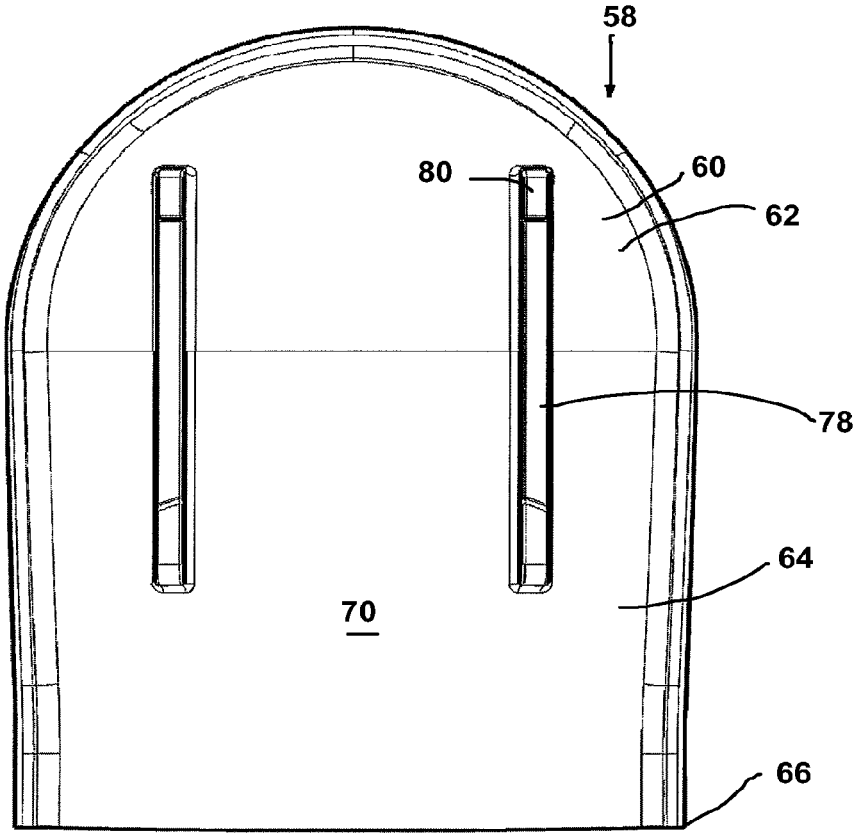
FIG. 7 is a front elevational view of the vent cover of FIG. 6.
Figure 8:
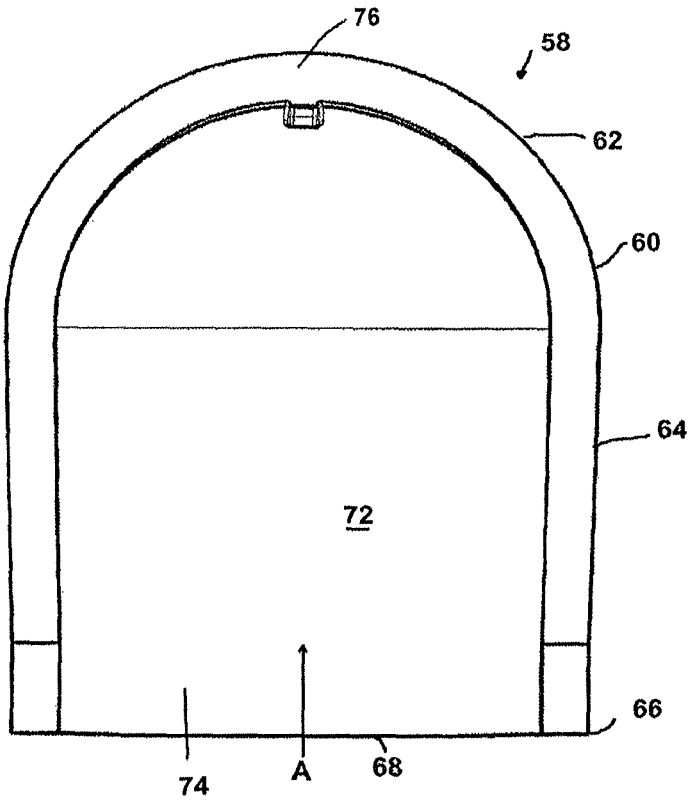
FIG. 8 is a rear elevational view of the vent cover of FIG. 6.
Figure 9:
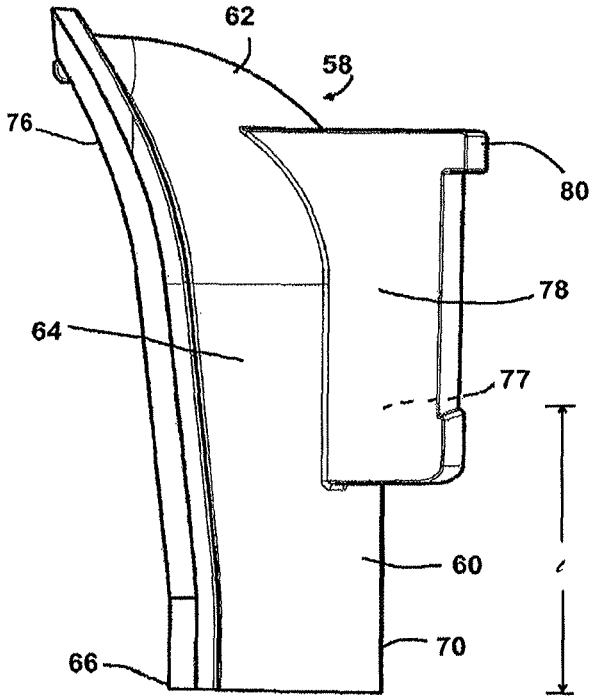
FIG. 9 is a side elevational view of the vent cover of FIG. 6.

Tests were conducted using various vent scoops having a configuration as shown in FIG. 6 but having a varying length as measured below the overflow scoop. The scoops were installed in the standard flush valve of 4.8 l/flush toilet, an American Standard® Champion Max® toilet having a model 4215 tank and a model 3195a bowl. Average peak flush rate (l/s) and average time(s) to 2,500 $cm^3/s$ (2,500 mils) data were measured for each of four sample toilets, each of which was flushed four times, using the 4.8 l flush capacity. The time to 2,500 Mk or greater is the time it takes from initiation of the flush cycle to reach an instantaneous flow rate from the outlet of the bowl that is 2,500 ml/s or more. A peak flow curve was generated through testing in which a toilet bowl was set on a flush stand. The bowl was set to the desired water consumption and water pressure. A Toledo® Speedweight scale was placed under the bowl. A bucket was placed on the scale. The distance form the bowl outlet to the standard bucket (having 12 inch diameter) was set to 17 inches. The scale logged data at a rate of 25 data points per second. The Toledo® scale was connected to a data logging system. The bowl was flushed to gather the data. The time to peak rate was measured from the first data point to where the peak value was achieved in the flow curve data. The time to 2,500 ml/s was also determined from the gathered data.

The average for these parameters and their standard deviation are reported in Table 1 below. Comparative Sample 1 has no vent cover. Inventive Sample 1 had a vent cover having the configuration as shown in FIG. 6 installed in the same valve body. In the sample, the vent cover had a length as measured longitudinally from the center of the overflow tube inlet opening (the inlet having a diameter of 30 mm) to the bottom of the vent cover, i.e., at the inlet opening of the vent cover of 85 mm (65 mm from the bottom of the overflow inlet opening). Inventive Sample 2 used a vent cover as shown in FIG. 6 but with a length measured longitudinally from the center of the inlet opening of the overflow tube to the bottom inlet end of the installed vent cover of 40 mm (25 mm from the bottom of the overflow tube inlet). The test data in Table 1 show an improvement in hydraulic performance and a faster flush. The data in this Example demonstrate a reduction in the variability in time to peak or time to 2,500 ml/s (i.e., a lower standard deviation). The mixing of air and water during the milliseconds of a flush is chaotic. Air may or may not find a path to escape. When it cannot escape, it blocks the efficient flow of water and there is a delay in time to peak. Addition of the vent scoop reduces the probability of this occurrence, and thus, the data shows a lower standard deviation in time to peak or time to 2,500 ml/s. The average time to peak or to 2,500 ml/s across multiple bowls and flush cycles may thus be reduced because the occasions of delayed times to peak flush cycles are reduced or eliminated.

TABLE 1

| Vent Sample | Peak Rate (l/s) | Time to 2,500 $cm^3/s$ (s) |
|---|---|---|
| Comp. Sample 1 - average | 3.55 | 0.48 |
| Comp. Sample 1 - std. deviation | 0.44 | 0.23 |
| Inv. Sample 1 - average | 3.54 | 0.36 |
| Inv. Sample 1 - std. deviation | 0.31 | 0.05 |
| Inv. Sample 2 - average | 3.54 | 0.32 |
| Inv. Sample 2 - std. deviation | 0.28 | 0.05 |

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A vent cover for use with a flush valve assembly, comprising a vent cover wall including:

an upper portion, a lower portion configured to define a vent cover inlet opening for receiving air and/or fluid passing upwardly from within a valve body and/or from within a toilet through a toilet inlet when the vent cover is installed on a valve body, an exterior surface, and an interior surface defining a vent cover passage for air and/or fluid passing upwardly from the vent cover inlet opening, wherein at least the upper portion of the vent cover wall has an outer edge that is arcuate such that the outer edge is configured to fit flush against a curved interior surface of a valve body at a location above an inlet of an overflow tube or a venting tube on a valve body when the vent cover is installed on a valve body, and wherein the vent cover wall is configured to at least partially divert flow of fluid from entering an inlet of an overflow tube or a venting tube on a valve body when the vent cover is installed on a valve body.

2. The vent cover for use with a flush valve assembly according to claim 1, wherein the vent cover wall is configured to allow air and/or fluid entering the vent cover from the vent cover inlet opening to pass upwardly through the vent cover passage and to exit the vent cover into an inlet of an overflow tube or a venting tube of a valve body when the vent cover is installed on a valve body.

3. The vent cover for use with a flush valve assembly according to claim 1, wherein the vent cover comprises a polymeric material.

4. The vent cover for use with a flush valve assembly according to claim 1, wherein when the vent cover is installed in a valve body having an overflow or venting tube with an inlet, the vent cover has a length measured longitudinally along a longitudinal axis of the vent cover from a bottom of an inlet of an overflow or venting tube to the inlet on the lower portion of the vent cover of greater than 0 to about 100 mm.

5. The vent cover for use with a flush valve assembly according to claim 4, wherein the length is about 10 mm to about 70 mm.

6. The vent cover for use with a flush valve assembly according to claim 5, wherein the length is about 25 mm to about 65 mm.

7. The vent cover for use with a flush valve assembly according to claim 1, wherein the vent cover wall is curved and has a body portion below the upper portion of the vent cover wall and above the lower portion of the vent cover wall and the inlet opening, the vent cover wall has a generally semi-circular configuration in transverse cross-section and has a radius measured in a transverse direction across the vent cover such that the passage through the vent cover within the body portion of the vent cover wall also has a generally semi-circular configuration.

8. The vent cover for use with a flush valve assembly according to claim 7, wherein the body portion of the vent cover wall is tapered to conform to a tapered valve body and the radius of the vent cover wall decreases from the upper portion to the lower portion of the vent cover wall.

9. The vent cover for use with a flush valve assembly according to claim 7, wherein the vent cover wall has an outer edge along the upper portion and the body portion of the vent cover wall, and the upper portion of vent cover wall is arcuately curved such that the radius of the vent cover wall decreases along the upper portion of the vent cover wall from the body portion of the vent cover wall towards the edge of the upper portion of the vent cover wall.

10. The vent cover for use with a flush valve assembly according to claim 1, wherein the vent cover is formed of a material capable of being affixed to an interior surface of a valve body of a flush valve by an adhesive, ultrasonic welding and/or polymeric heat welding.

11. The vent cover for use with a flush valve assembly according to claim 1, wherein the vent cover is formed of a material capable of being heat molded to an interior surface of a valve body of a flush valve.

12. The vent cover for use with a flush valve assembly according to claim 1, further comprising projections extending outwardly from the exterior surface of the vent cover wall configured for engaging a feature of a valve body and/or an interior surface of a valve body of a flush valve upon installation of the vent cover.

13. A flush valve assembly, comprising a valve body having an upper inlet end having an inlet opening therethrough for receiving fluid into the flush valve body, a lower outlet end having an outlet opening therethrough for allowing fluid to exit the flush valve body, and a valve body wall extending between the upper inlet end and the lower outlet end and having a curved interior surface defining a flow path that extends generally longitudinally through the valve body from the inlet opening to the outlet opening, a valve body cover capable of opening and closing over the inlet opening of the valve body, an overflow or venting tube, having an inlet opening in communication with the flow path of the valve body and an outlet opening for releasing air and/or fluid from within the valve body, a vent cover having a vent cover wall, wherein the vent cover wall has with an upper portion, a lower portion defining an inlet opening for receiving air passing upwardly from within the valve body flow path and/or from a toilet through a toilet inlet, an exterior surface, and an interior surface defining a vent cover passage for receiving air from the inlet opening of the vent cover, wherein at least the upper portion of the vent cover wall has an outer edge that is arcuate such that the outer edge contacts and fits flush against the curved interior surface of the valve body at a location above the inlet opening of the overflow or venting tube and the vent cover wall is configured to at least partially divert flow of fluid from entering an inlet of an overflow tube or a venting tube on a valve body when the vent cover is installed on a valve body.

14. The flush valve assembly according to claim 13, wherein the vent cover is configured to allow air and/or fluid entering the vent cover from the vent cover inlet opening to pass upwardly through the vent cover passage and to exit the vent cover through the inlet opening of the overflow or venting tube.

15. The flush valve assembly according to claim 13, wherein the upper inlet end of the valve body comprises a radiused inlet.

16. The flush valve assembly according to claim 15, wherein the valve body is an elevated valve body, and the valve cover is a buoyant poppet float coaxially mounted in the valve body for reciprocating motion with respect to said valve body along a guide member.

17. The flush valve assembly according to claim 13, wherein the valve body is an elevated valve body that has a height measured longitudinally along the valve body which is greater than a largest diameter of the valve body.

18. The flush valve assembly according to claim 13, wherein at least a portion of the interior surface of the valve body wall is downwardly linearly tapered and has a decreasing valve body diameter as measured transversely across the valve body.

19. The flush valve assembly according to claim 18, wherein the valve body wall comprises an upper inlet section, a base section for attaching to a toilet tank floor, and an extension section situated between the inlet section and the base section and wherein at least one of an interior surface of the base section and of the extension section is tapered so as to have a linearly decreasing diameter from an upper end of each section in a direction toward a lower end of each section, wherein the diameters are measured transversely across each section.

20. The flush valve assembly according to claim 18, wherein the valve body is an elevated valve body, the upper inlet end of the valve body further comprises a radiused inlet and the tapered portion of the valve body wall is below the radiused inlet portion.

21. The flush valve assembly according to claim 19, wherein the valve body wall comprises an upper inlet section, a base section for attaching to a toilet tank floor, and an extension section situated between the inlet section and the base section and wherein at least one of an interior surface of the base section and of the extension section is tapered so as to have a linearly decreasing diameter from an upper end of each section in a direction toward a lower end of each section, wherein the diameters are measured transversely across each section.

22. The flush valve assembly according to claim 13, wherein the vent cover wall is curved and has a body portion below the upper portion of the vent cover wall and above the lower portion of the vent cover wall and the vent cover inlet opening, the vent cover wall has a generally semi-circular configuration in transverse cross-section and has a radius measured in a transverse direction across the vent cover such that the vent cover passage within the body portion of the vent cover wall also has a generally semi-circular cross-sectional configuration.

23. The flush valve assembly according to claim 22, wherein the radius of the vent cover wall is constant in the body portion of the vent cover wall.

24. The flush valve assembly according to claim 22, wherein at least a portion of the interior surface of the valve body is tapered and the body portion of the vent cover wall has an outer edge which is also tapered to conform to the interior surface of the valve body and the radius of the vent cover decreases from the upper portion to the lower portion of the vent cover wall.

25. The flush valve assembly according to claim 22, wherein the upper portion of vent cover wall is further arcuately configured to curve towards the interior surface of the valve body and wherein the radius of the vent cover wall measured transversely across the vent cover decreases along the upper portion of the vent cover wall as the vent cover wall approaches the interior surface of the valve body.

26. The flush valve assembly according to claim 13, wherein the vent cover is affixed to the interior surface of the valve body by an adhesive, ultrasonic welding and/or polymeric heat welding.

27. The flush valve assembly according to claim 13, wherein the vent cover is heat molded to the interior surface of the valve body.

28. The flush valve assembly according to claim 13, wherein the vent cover is molded as a unitary part of the valve body.

29. The flush valve assembly according to claim 13, wherein the vent cover further comprises projections extending outwardly from the exterior surface of the vent cover wall which are configured for engaging a feature of the valve body and/or the interior surface of the valve body.

30. The flush valve assembly according to claim 13, wherein the upper inlet end of the valve body comprises a radiused inlet, the valve body is an elevated valve body, and the valve cover is a buoyant poppet float coaxially mounted in the valve body for reciprocating motion with respect to said valve body along an guide member, and wherein the vent cover further comprises projections extending outwardly from the exterior surface of the wall and configured for engaging the guide member of the valve body.

31. A flush valve assembly for a toilet tank, the flush valve assembly, comprising, a flush valve having a valve body comprising an upper inlet end having an inlet opening therethrough for receiving fluid into the flush valve body, wherein the upper inlet is a radiused inlet, a lower outlet end having an outlet opening therethrough for allowing fluid to exit the flush valve body, and a valve body wall extending between the upper inlet end and the lower outlet end and having a curved interior surface defining a flow path that extends generally longitudinally through the valve body from the inlet opening to the outlet opening, wherein the valve body has an elevated base section; and a movable poppet cover capable of moving in a coaxial, reciprocating manner; and a vent cover having a vent cover wall, wherein the vent cover wall has with an upper portion, a lower portion defining an inlet opening for receiving air passing upwardly from within the valve body flow path and/or from a toilet through a toilet inlet, an interior surface defining a vent cover passage for receiving air from the inlet opening of the vent cover, wherein at least the upper portion of the vent cover wall has an outer edge that is arcuate such that the outer edge contacts and fits flush against the curved interior surface of the valve body wall at a location configured to at least partially divert flow of fluid in a valve body when the vent cover is installed and/or to facilitate escape of trapped air.

32. The flush valve assembly according to claim 31, wherein the flush valve poppet cover comprises a guide rod and the valve body comprises a web structure having a central hole configured to receive the guide rod, and the guide rod is capable of reciprocatably and coaxially moving within the hole so as to raise the poppet cover to allow fluid to flow into the inlet of the flush valve in an open position and to allow for aligned axial movement of the poppet cover when the flush valve moves to a closed position.

* * * * *